US008985028B2

(12) United States Patent
Gustafson

(10) Patent No.: US 8,985,028 B2
(45) Date of Patent: Mar. 24, 2015

(54) MULTIPLE CABLE ZIP LINE RIDE

(75) Inventor: Steven R. Gustafson, Rockford, IL (US)

(73) Assignee: Experience Based Learning, Inc., Rockford, IL (US)

( * ) Notice: Subject to any disclaimer, the term of this patent is extended or adjusted under 35 U.S.C. 154(b) by 403 days.

(21) Appl. No.: 13/216,822

(22) Filed: Aug. 24, 2011

(65) Prior Publication Data

US 2012/0048138 A1 Mar. 1, 2012

Related U.S. Application Data

(60) Provisional application No. 61/376,646, filed on Aug. 24, 2010.

(51) Int. Cl.

| | |
|---|---|
| ***B61B 7/00*** | (2006.01) |
| ***A63G 1/00*** | (2006.01) |
| ***A63G 21/22*** | (2006.01) |

(52) U.S. Cl.

CPC ..... *A63G 21/22* (2013.01)
USPC ..... 104/112; 104/53

(58) Field of Classification Search

USPC ..... 104/112–115, 165, 173.1, 173.2
See application file for complete search history.

(56) References Cited

U.S. PATENT DOCUMENTS 4,159,113 A * 6/1979 Callecod ..... 482/36

* cited by examiner

*Primary Examiner* — R. J. McCarry, Jr.
(74) *Attorney, Agent, or Firm* — Reinhart Boerner Van Deuren P.C.

(57) ABSTRACT

A multiple cable zip line ride is provided. The ride includes a support structure with a cross beam mounted to the support structure for routing and mounting of a plurality of cables of the zip line ride. The cables are mounted to the cross beam such that multiple users can travel simultaneously in the same direction along the cables. The cross beam provides for the mounting of additional safety cables and tensioning devices.

20 Claims, 10 Drawing Sheets

MULTIPLE CABLE ZIP LINE RIDE

CROSS-REFERENCE TO RELATED PATENT APPLICATIONS

This patent application claims the benefit of U.S. Provisional Patent Application No. 61/376,646, filed Aug. 24, 2010, the entire teachings and disclosure of which are incorporated herein by reference thereto.

FIELD OF THE INVENTION

This invention generally relates to recreational suspended cable transport systems commonly known as zip lines and more particularly to the structure used for affixing the cables of a zip line.

BACKGROUND OF THE INVENTION

Zip lines are an increasingly popular recreational thrill ride. In a typical zip line, a user is suspended from a cable and travels from one point at a high elevation to another point at a lower elevation at a relatively high speed. The use of zip lines in resort and outdoor settings continues to grow in popularity. As such, there is a growing need for zip lines that can handle a high volume of users in a safe and efficient manner.

A typical zip line ride has a plurality of towers that are connected to one another via cables. With reference to FIG. 14, a common design for a tower 202 is illustrated. The tower 202 has a vertical pole 204 supported by guy wires 206. As illustrated, there is typically one "outbound" cable 208 and one "inbound" cable 214 per tower 202 connected to the vertical pole 204. A platform 212 is situated under the cables 208, 214.

A user leaves the platform 212 via the outbound cable 208 along direction 216. Similarly, a user arrives at the platform 212 via the inbound cable 214 along direction 218. A carriage 210 is suspended from each cable 208, 214. A user typically stands on the platform 212 underneath one of the cables 208, 214 and connects (when preparing to depart the platform 212) or disconnects to the carriage 210 (after arriving at the platform 212) via a harness or the like.

Unfortunately, the design illustrated in FIG. 14 has several disadvantages. As one example, the tower 202 is generally limited in the number of cables 208, 214 it can employ. Indeed, a typical tower 202 generally has only a single outbound cable 208 and a single inbound cable 214. Moreover, typically only one user can travel on a cable 208, 214 at a time. As a result, a tower 202 can often times have a long queue of people waiting to ride the zip line. This long queue can discourage many potential users from riding the zip line. Further, many potential users would rather ride simultaneously with someone else and forgo riding alone due to fear or lack of interest.

As another example, the cables 208, 214 wrap around the pole 204 and are tied off to themselves. The trolleys 210 cannot ride along the cables 208, 214 at the tied off portions. As a result, there is a reduced amount of platform 212 space, e.g. width W1 relative to the outbound cable 208, for a user to stand on when connecting or disconnecting from the trolleys 210. Such a configuration limits the available space for an operator to utilize when harnessing a user, and also generally prevents multiple users from standing on the platform when waiting to ride the zip line.

As yet another example, in certain embodiments, a tower 202 can include a pair of support poles 204 that are arranged in parallel with the platform 212 commonly mounted to both poles 204. Each pole 204 has at least one cable 208, 214 extending therefrom. However, as a user rides on one cable 208, 214, the pole 204 carrying the cable 208, 214 ridden upon will deflect. The forces caused by this deflection are transferred through the platform 212 to the other pole 204. This can change the ride dynamics of the cable attached to the other pole to such an extent that only a single user can ride on a cable at a time, notwithstanding that the particular tower employs multiple cables in the same direction.

In view of the above, there is a need in the art for a zip line ride that can accommodate multiple simultaneous users in inbound and outbound directions from a tower. The invention provides such a zip line ride. These and other advantages of the invention, as well as additional inventive features, will be apparent from the description of the invention provided herein.

BRIEF SUMMARY OF THE INVENTION

In view of the above, embodiments of the present invention provide a zip line ride that can accommodate multiple simultaneous users in inbound and outbound directions. More particularly, embodiments of the present invention provide a new and improved zip line ride that incorporates a cross beam transversely mounted to a support structure. The cross beam and support structure present a ridged frame that provides an increased resistance to deflections when one or more users use the zip line ride. Still more particularly, embodiments of the present invention provide a zip line system that incorporates multiple towers each having at least one cross beam such that the system can accommodate a high amount of user traffic thereby reducing the queue at any given tower of the zip line system.

In one embodiment, a zip line tower is provided. The zip line tower according to this embodiment includes a support structure including at least one generally vertical support pole with a cross beam mounted transversely thereto. A platform is mounted to the at least one generally vertical support pole. A plurality of cables are also mounted to the cross beam. The plurality of cables extend over the platform and to a termination point. The plurality of cables are spaced apart along the cross beam to permit simultaneous connection and use of the plurality of cables by users to travel between the platform and the termination point. In another embodiment, the at least two cables include at least two outbound cables extending away from the cross beam in a first direction. In yet another embodiment, the plurality of cables includes at least two inbound cables extending away from the cross beam in a second direction that is different from the first direction.

In another embodiment, the outbound cables extend away from the cross beam at a first angle that is negative relative to the platform. At least two inbound cables extend away from the cross beam at a second angle that is positive relative to the platform.

In another embodiment, the support structure includes a pair of support poles. The cross beam is transversely mounted to the pair of support poles. In another embodiment, at least one cable of the plurality of cables is routed through a routing structure mounted to the cross beam. The at least one cable is fixedly attached to one of the pair of support poles by a mounting structure. In yet another embodiment, the zip line tower further includes at least one safety cable. The at least one safety cable has a first end and a second end. The first end is fixedly mounted to the cross beam. The second end is fixedly mounted to the at least one cable between the routing structure and the mounting structure.

In another embodiment, the zip line tower further includes a cable tensioning device connected between an end of the at least one cable and the mounting structure. The tensioning device is operable to increase or decrease a tension in the at least one cable.

In another embodiment, the zip line tower further includes a platform mounted to the support structure below the cross beam. The plurality of cables includes a first cable and a second cable. The first cable is tangent to the cross beam at a first point of tangency and the second cable is tangent to the cross beam at a second point of tangency. The first point of tangency is higher than the second point of tangency relative to the platform.

In another embodiment, a zip line system is provided. The zip line system includes at least two towers. At least two cables extend between a first and a second tower of the at least two towers in the same direction. The at least two cables are operable to transport two users of the zip line system simultaneously in the same direction between the first tower and the second tower. In another embodiment, each of the at least two towers include a support structure and at least one cross beam transversely mounted to the support structure. In another embodiment, the at least two cables are fixedly attached to the cross beam. In yet another embodiment, the at least two cables are routed through a routing structure mounted to the at least one cross beam and mount to the support structure.

In another embodiment, the support structure is a single pole. The at least one cross beam includes a first cross beam mounted above a second cross beam. The at least two cables include a first pair of cables connected the first cross beam and a second pair of cables connected to the second cross beam.

In another embodiment, the support structure is a pair of poles. The at least one cross beam includes a first cross beam mounted above a second cross beam to the pair of poles. The at least two cables include a first pair of cables connected to the first cross beam and a second pair of cables connected to the second cross beam.

In another embodiment, a method for operating a zip line system is provided. The method according to this embodiment includes steps of connecting a first user to a first cable and connecting a second user to a second cable. The first and second cables are connected to a cross beam of a first tower and a cross beam of a second tower. The method further includes transporting the first and second users between the first and second towers.

In another embodiment, the step of transporting includes transporting the first and second users simultaneously in the same direction between the first and second towers.

In another embodiment, the method further includes the step of disconnecting the first user from the first cable and disconnecting the second user from the second cable. The steps of disconnecting are completed at a higher elevation than the steps of connecting relative to ground.

Other aspects, objectives and advantages of the invention will become more apparent from the following detailed description when taken in conjunction with the accompanying drawings.

BRIEF DESCRIPTION OF THE DRAWINGS

The accompanying drawings incorporated in and forming a part of the specification illustrate several aspects of the present invention and, together with the description, serve to explain the principles of the invention. In the drawings.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

Figure 1:
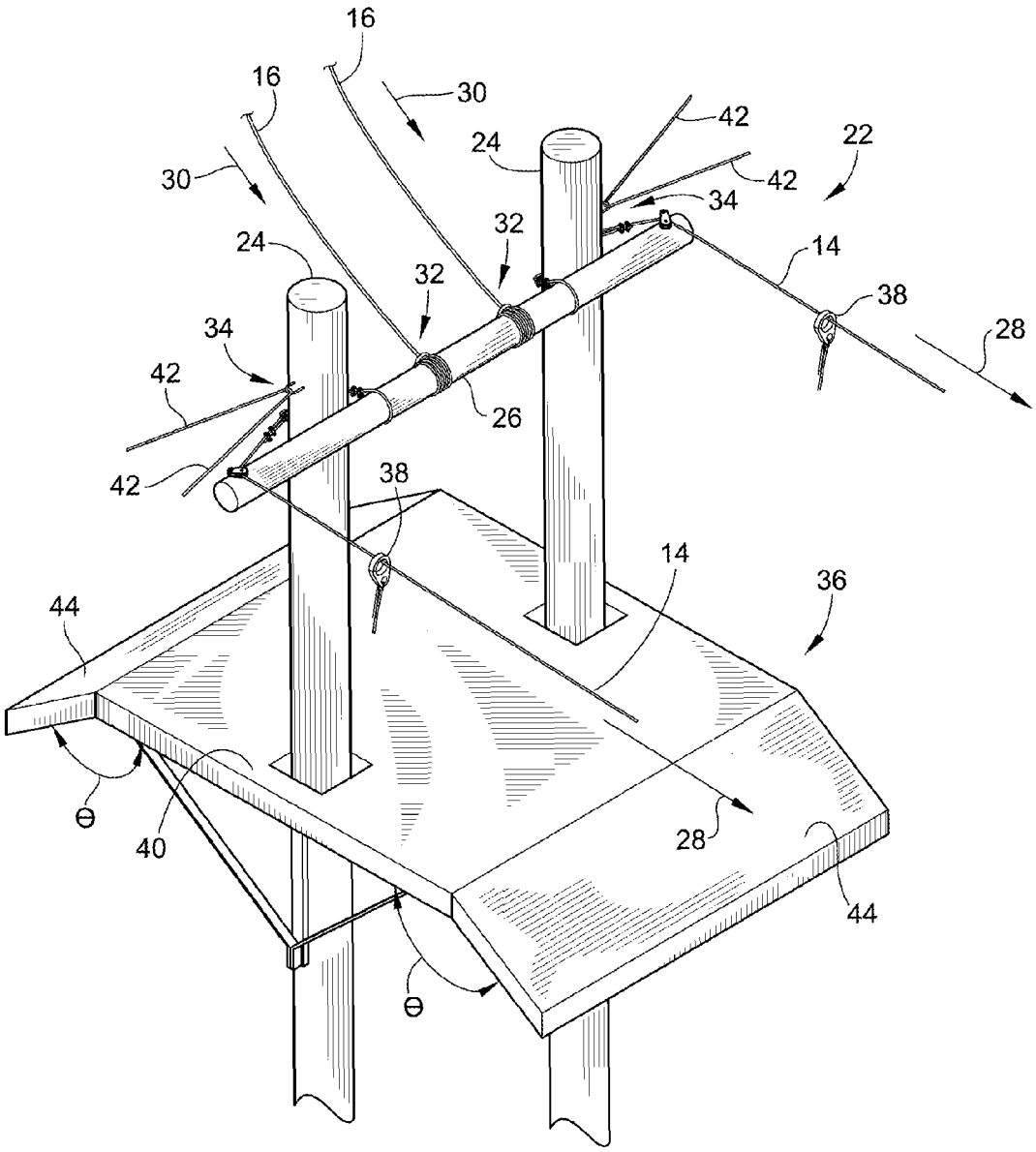
FIG. 1 is a partial perspective view of an exemplary embodiment of a tower of the multi cable canopy tour according to the teachings of the present invention.

Turning now to the drawings, there is illustrated in FIG. 1 a zip line tower 22 incorporating a plurality of cables 14, 16 that extend from the tower 22 to a termination point. More specifically, the zip line tower 22 incorporates one or more outbound cables 14 that allow multiple users to depart the zip line tower 22 and ride along the outbound cables 14 in an outbound direction 28 simultaneously. Likewise, the zip line tower 22 incorporates one or more inbound cables 16 that allow multiple users to arrive at the zip line tower 22 by riding along the inbound cables in an inbound direction 30 simultaneously. The termination point may be another tower 22, or a different structure such as a ground based deck.

Figure 14:
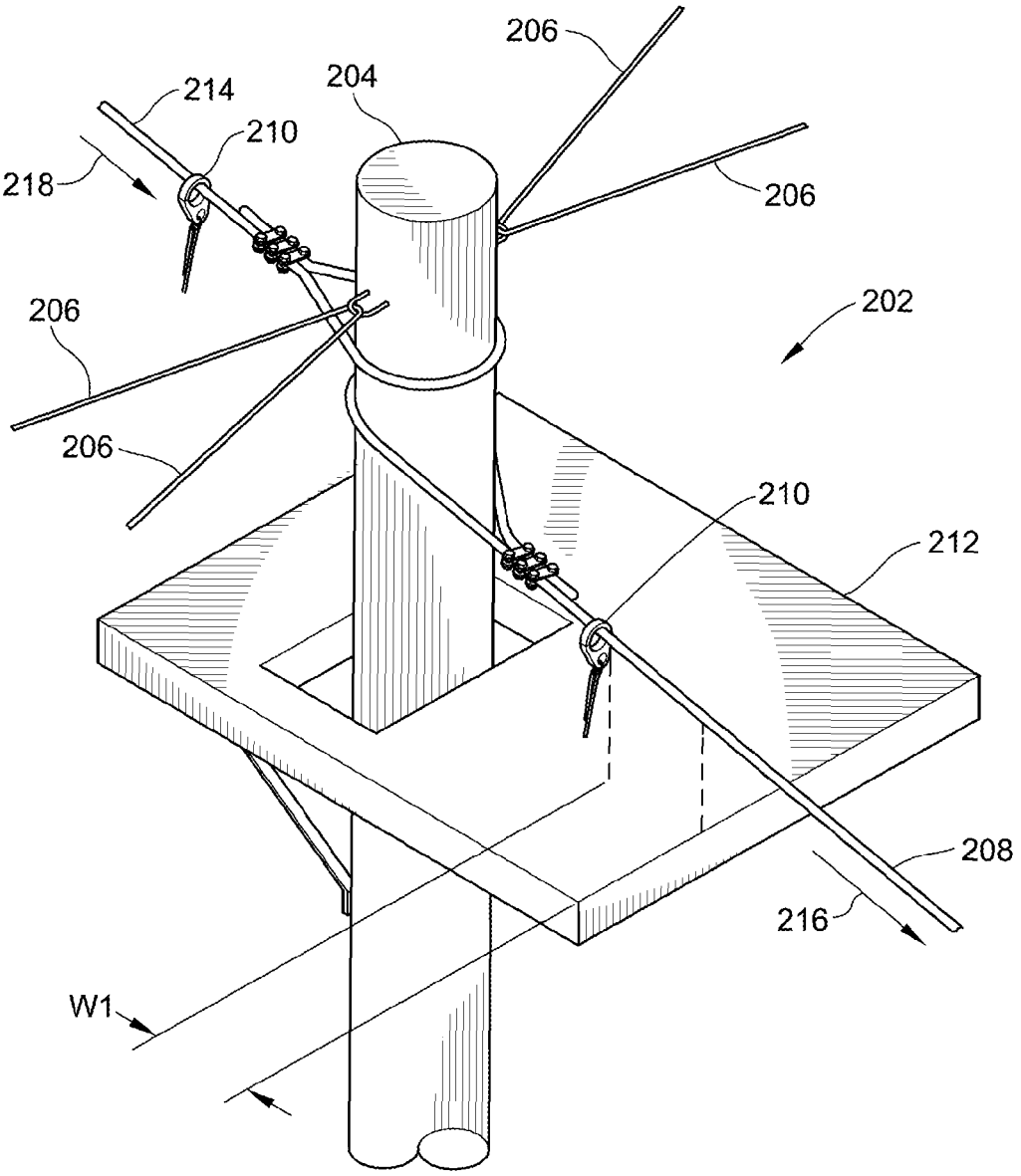
FIG. 14 PRIOR ART
FIG. 14 is a partial perspective view of a prior design of a tower.

As a result, the zip line tower 22 can accommodate more users in a given period of time than the prior designs discussed above. As will be discussed in greater detail below, the zip line tower 22 achieves these advantages in part by using a cross beam 26 that the cables 14, 16 mount to, as opposed to mounting directly to the support pole 24 as in prior designs such as that illustrated in FIG. 14. Additionally, the cross beam 26 provides for a more stable structure such that the loading and deflections caused when one cable 14, 16 is in use does not affect the other cable 16.

Although illustrated as incorporating two outbound cables 14 and two inbound cables 16, it is recognized that in other embodiments the zip line tower 22 can incorporate more or fewer cables in each direction. As such, while the following description will utilize such an exemplary environment in describing various features and functionality of the present invention, such description should be taken by way of example and not by limitation.

The zip line tower 22 illustrated in FIG. 1 includes a pair of support poles 24 interconnected by a cross beam 26. A platform 36 is mounted to the support poles 24 and is situated under the cross beam 26. As illustrated, the cables 14, 16 are connected to the cross beam 26. The outbound cables 14 extend away from the cross beam 26 at a negative angle relative to the platform 36, whereas the inbound cables extend away from the cross beam 26 at a positive angle relative to the platform. As will be discussed in greater detail below, the cables 14, 16 can mount to the cross beam 26 in a variety of ways. As one example, the cables 14, 16 may wrap around the cross beam 26 and be clamped to themselves in a first mounting arrangement 32, such as that shown relative to the inbound cables 16.

Alternatively, the cables 14, 16 may be routed around the cross beam 26 and one of the support poles 24 in a second mounting arrangement 34, such as that shown relative to the outbound cables 14. The particular mounting arrangement used is independent of whether the cable is an outbound cable 14, or an inbound cable 16.

The support poles 24 are generally co-parallel and extend vertically from the ground. The support poles 24 are structurally rigid and have a cylindrical shape, but other cross sectional shapes are contemplated, e.g. square, triangular, octagonal, etc. The support poles 24 may be wooden or formed from any other suitably rigid material, e.g. metal, concrete, composites, etc. The support poles 24 may also be embodied as a natural object, such as a tree. The cross beam 26 extends between the support poles 24 such that the cross beam 26 and support poles form a structurally rigid frame. Guy wires 42 are used to tether the frame formed by the cross beam 26 and support poles 24 to the ground. It will be recognized that due to its rigidity, the zip line tower 22 as illustrated utilizes the same number of guy wires 42 as prior designs discussed above utilizing a single support pole. Additionally, although illustrated as incorporating multiple support poles 24, the cross beam 26 carrying multiple cables 14, 16 can be supplied in embodiments using a single support pole 24.

The cross beam 26 can be mounted to the support poles 24 in a variety of ways including, but not limited to, cables or other fasteners such as bolts or rivets. The cross beam 26 also carries a variety of cable routing and mounting devices, e.g. clevises, swaged eyes, and pulleys, for mounting the cables 14, 16 to the cross beam 26. Alternatively, and with particular reference to the inbound cables 16, the cables may simply wrap around the cross beam 26 and tie off to themselves. However, it will be recognized from the following that the incorporation of the cross beam 26 allows for additional mounting and routing features such as safety cables and tensioning devices.

Further, it will be recognized that although the inbound cables 16 use a more simplified mounting arrangement 32 than the outbound cables 14, the inbound cables 16 can use a mounting arrangement 34 similar to that of the outbound cables 14. Indeed, the cross beam 26 provides the flexibility to utilize various mounting arrangements for the outbound and inbound cables 14, 16. As was the case with the support poles 24, the cross beam 26 can also have various cross sectional profiles other than the cylindrical profile illustrated. The cross beam 26 may be wooden or formed from any other suitably rigid material, e.g. metal, concrete, composites, etc.

The platform 36 is disposed generally below the cross beam 26 and is affixed to the support poles 24 using a plurality of braces 46. The platform includes openings 48 allowing the support poles 24 to freely pass therethrough. An access structure (not shown) such as a ladder extends up from the ground and along one or both of the support poles 24 up to the platform 36. Further, other access structures are contemplated, e.g. staircases or pegs extending from one or both of the support poles 24, etc.

In the illustrated embodiment, the platform 36 includes a base portion 40 and ramped portions 44 extending from either side of the base portion 40 at an angle θ. The ramped portions 44 allow for additional clearance for users of the tower 22 as they approach the platform 36 on the inbound cables 16. Additionally the ramped portions 44 also allow for greater user confidence as they are far enough below the outbound cables 14 to allow a user to "free hang" from the outbound cable 14 while still having a sense of security of a platform beneath them prior to departing the platform 36. In other embodiments, the ramped portions 44 may be omitted entirely, or larger and/or smaller than that illustrated.

The cross beam 26 advantageously allows for an increased amount of platform 36 space under the cables 14, 16. This additional space provides a user and an operator more area to stand on when connecting or disconnecting from any one of the cables 14, 16. More particularly, and with reference to FIG. 2, the zip line tower 22 is illustrated with an outbound cable 14 extending therefrom. A carriage 38 used to slide along the cable 14 while carrying user can be pulled inward from the edge of the platform 36 up to where it will abut with the cross beam 26. Contrast this with the prior design illustrated in FIG. 12, where the carriage can only go as far the area where the cable ties off to itself. As a result, there is an increased amount of platform space from the edge of the platform 36 to the cross beam 26, illustrated as width W2 in FIG. 2, available for a user and an operator of the zip line tower 22 to stand on when connecting to the outbound cable 14. It will be recognized that the same additional amount of platform space is available for the inbound cable 16.

Figure 2:
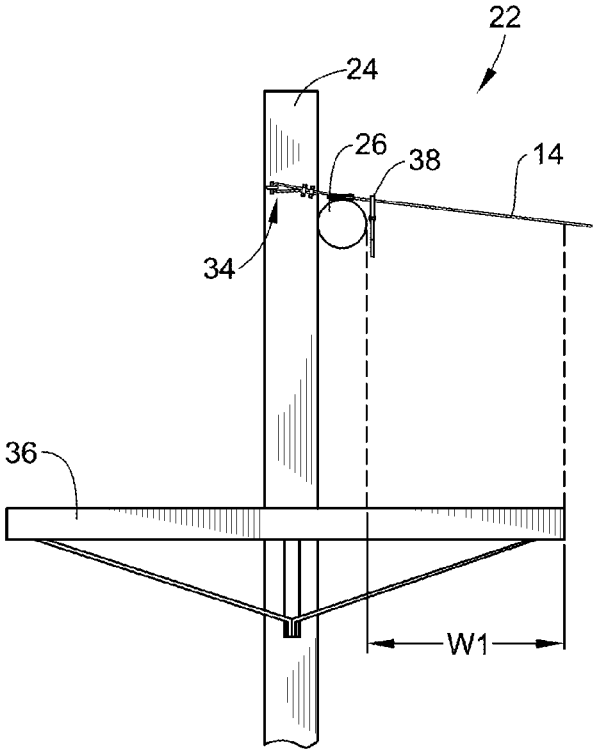
FIG. 2 is a partial side view of the tower of FIG. 1.
Figure 3:
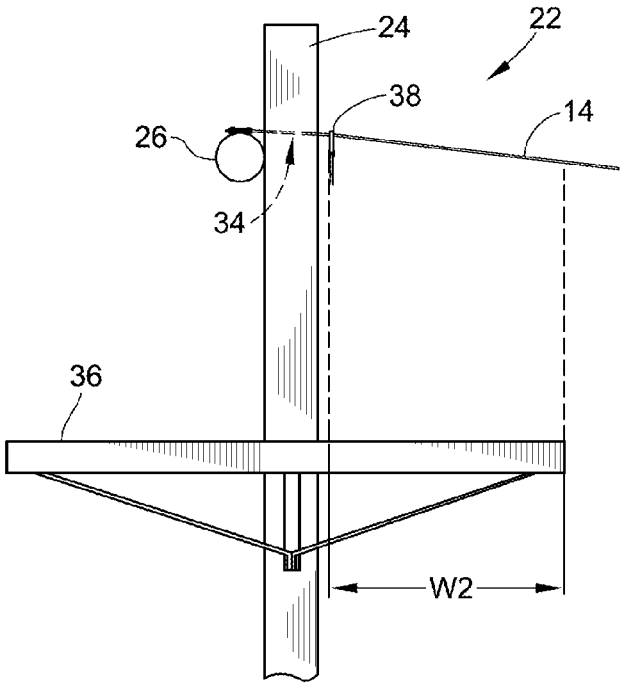
FIG. 3 is a partial side view of an alternative configuration of the tower of FIG. 1.

Turning now to FIG. 3, in an alternative mounting configuration the cross beam 26 can be placed on an opposite side of the support poles 24 as that illustrated in FIG. 2. As a result, the amount of platform space available for connecting to the outbound cable 28, illustrated by width W3, is even greater, as the space between the support poles 24 is also available for connection and disconnection to the outbound cable 14. It will be recognized that the widths W2, W3 shown at FIGS. 2 and 3 will be greater in the event a ramped portion 44 (see FIG. 1) is also incorporated.

Figure 4:
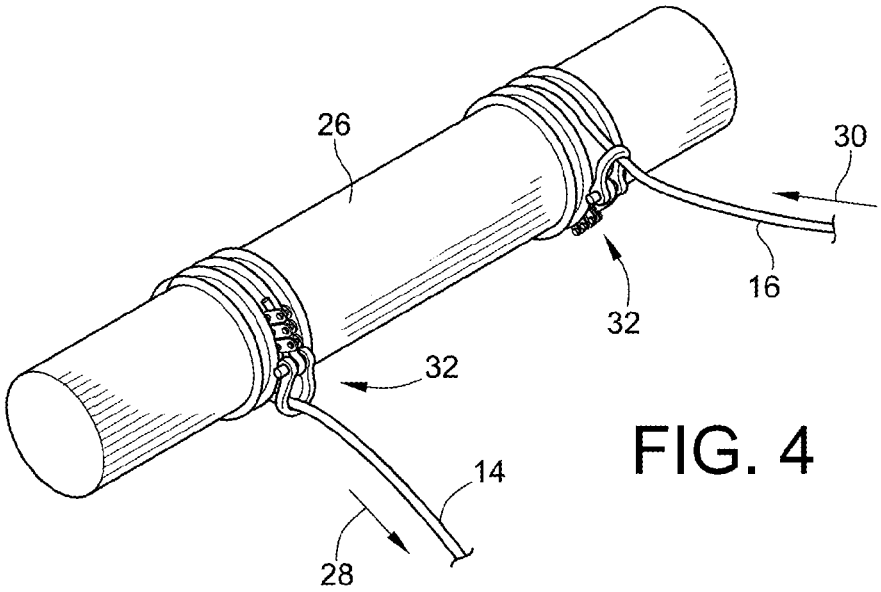
FIG. 4 is a partial perspective view of a cross beam of the tower of FIG. 1.

With reference to FIG. 4 another advantage of the cross beam 26 is the ability to mount the outbound and inbound cable 14, 16 thereto such that there is a general height difference between where a user connects to the outbound cable 14 and where a user disconnects from the inbound cable 16. Such an advantage may be achieved by arranging the cables 14, 16 along the cross beam 26 such that they extend therefrom at different angles using the first mounting arrangement 32. In the illustrated embodiment, the first mounting arrangement 32 includes wrapping the cables 14, 16 around the cross beam. Thereafter, the free end of each of the cables 14, 16 are folded over and coupled (e.g. swaged) to themselves to form an eyelet 50 at the free end of each cable 14, 16. A clevis 52 is inserted into each eyelet 50, and around the remainder of the cable 14, 16 it is associated with. Alternatively, the free end of the cables 14, 16 can be wrapped around the crossbeam 26, and then looped around the length of cable extending from the cross beam 26. Thereafter, the free end is swaged onto itself. As a result, the length of cable 14, 16 passes through an eyelet formed in the end of the cable, and no clevis is utilized.

As a result, the inbound cables 16 extend tangentially away from the cross beam 26 on an upper side thereof. This advantageously provides for additional elevation relative to the platform 36 as users approach the same. Likewise, the outbound cables 14 extend tangentially away from the cross beam 26 on a lower side thereof. It will be recognized that the point of tangency of the inbound cables 16 relative to the cross beam 26 is higher than the point of tangency of the outbound cables 14 relative to the cross beam 26. This advantageously provides for ease of connection to the outbound cables 14. That is, the outbound cables 14 extend tangentially away from the cross beam 26 at a height that is low enough for a majority of users to connect to the outbound cables while standing on the platform 36 and without the need for an additional ladder, stool, or the like. In other embodiments, the use of the cross-beam 26 can be omitted, and the inbound cable 16 wrapped on a support pole 24 or other vertical structure. The outbound cable 14 can be wrapped on the same support pole 24 or other vertical structure below the inbound cable 16 to achieve the same advantages in height distance. Further, the aforementioned cable wrapping arrangement utilizing a clevis 52, or the eyelet formed in the free end of the cable 14, 16 can be employed to ensure that the cables 14, 16 extend from opposite sides of the support pole 24 and do not converge onto a single centered point on the support pole 24. Such an embodiment will allow for more room for an operator to assist attaching and detaching users from the cables 14, 16.

Figure 5:
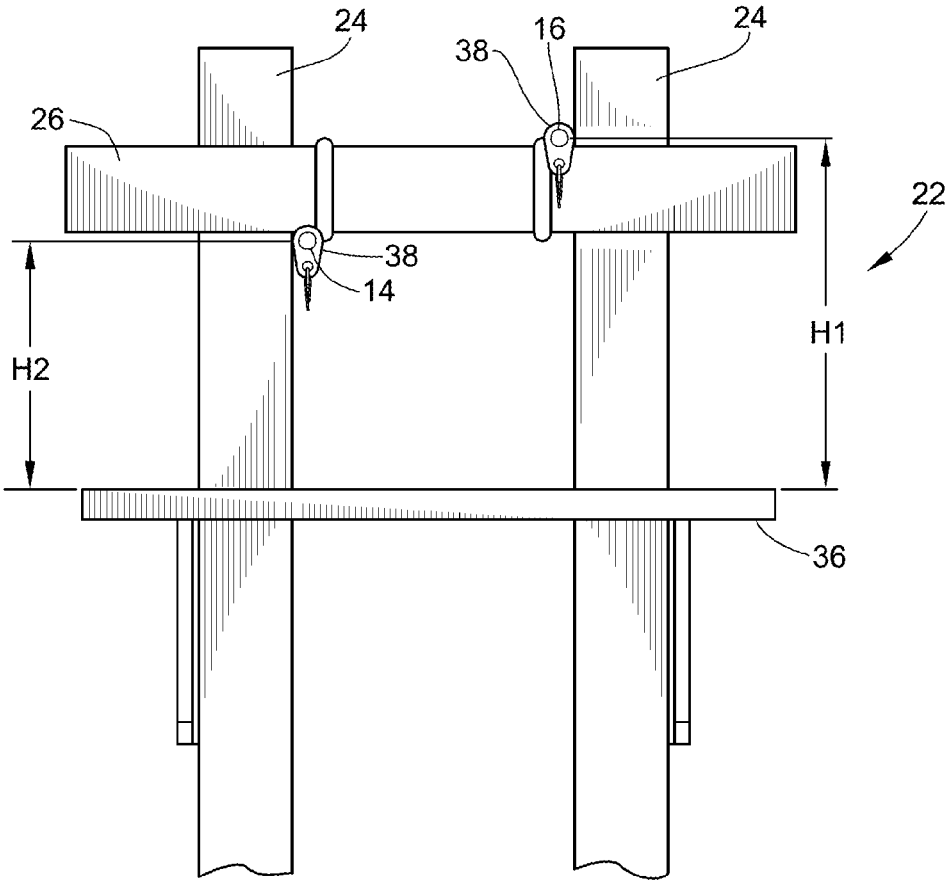
FIG. 5 is a front view of a platform, support poles, and the cross beam of the tower of FIG. 1.

With reference to now to FIG. 5, as a result of the above-noted height difference, the point or region of the inbound cable 16 upon which the user disconnects from (illustrated at height H1) is generally higher than the point or region of the outbound cable 14 upon which the user connects to (illustrated as height H2). The inbound cable 16 is at a height H1 that is high enough so that a user will not strike the platform 36 when arriving at the same. Conversely, it is desirable that the outbound cable 14 be at a height H2 relative to the platform 36 such that a user can stand on the platform 36 comfortably while connecting to the outbound cable 14. In one embodiment, H1 is preferably about 7 feet, more preferably 9 feet, and even more preferably about 10 feet. Also in one embodiment, H2 is about 7 feet, more preferably 6 feet, and even more preferably 5 feet.

It will be recognized from inspection of FIG. 5 that the cables 14, 16 are shown generally mounted to the cross beam 26, however, either of the mounting arrangements 32, 34 discussed above relative to FIGS. 1 and 2 can be used to achieve the desired heights H1 and H2. Put differently, either of the first and second mounting arrangements 32, 34 can be used in conjunction with the cross beam 26 to mount the cables 14, 16 such that they extend away from the cross beam 26 at different angles.

Figure 6:
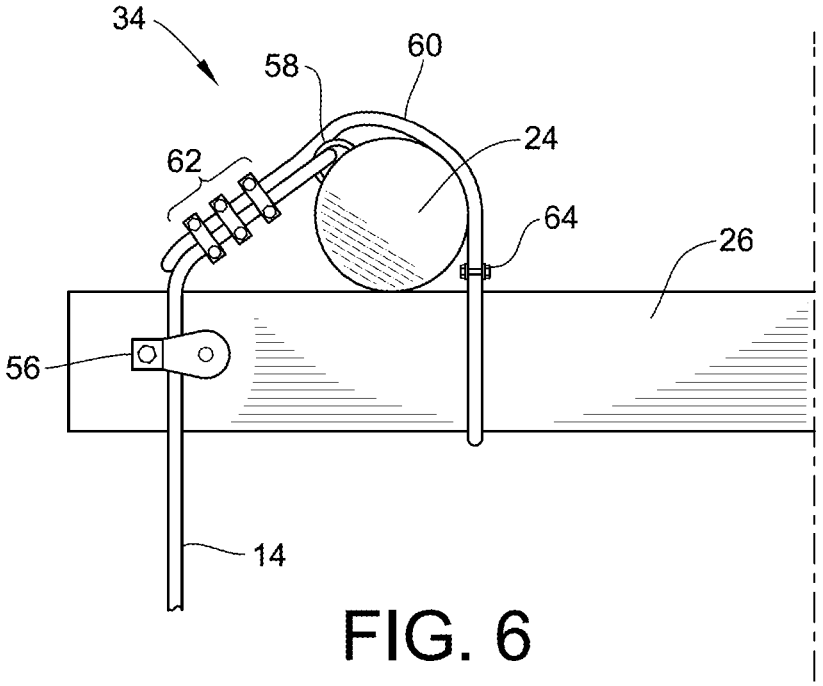
FIG. 6 is a partial top view of the cross beam and one support pole of the tower of FIG. 1 with a cable and a safety cable mounted thereto.

Turning now to FIG. 6, one configuration of the second mounting arrangement 34 is illustrated. In this configuration, the outbound cable 14 passes through a routing structure such as a clevis 56 mounted to the cross beam 26 and terminates at a mounting structure 58 of the support pole 24. The mounting structure 58 can be any structure sufficient to fix the cable to the support pole 24, e.g. a ring mount or similar structure.

A safety cable 60 is connected to the outbound cable 16 at a first termination 62. The safety cable 60 also wraps around the support pole 24 and crossbeam 26 and ties off to itself at a second termination 64. The first and second terminations 62, 64 can be achieved using clips or other structures used to bind cables together.

Figure 7:
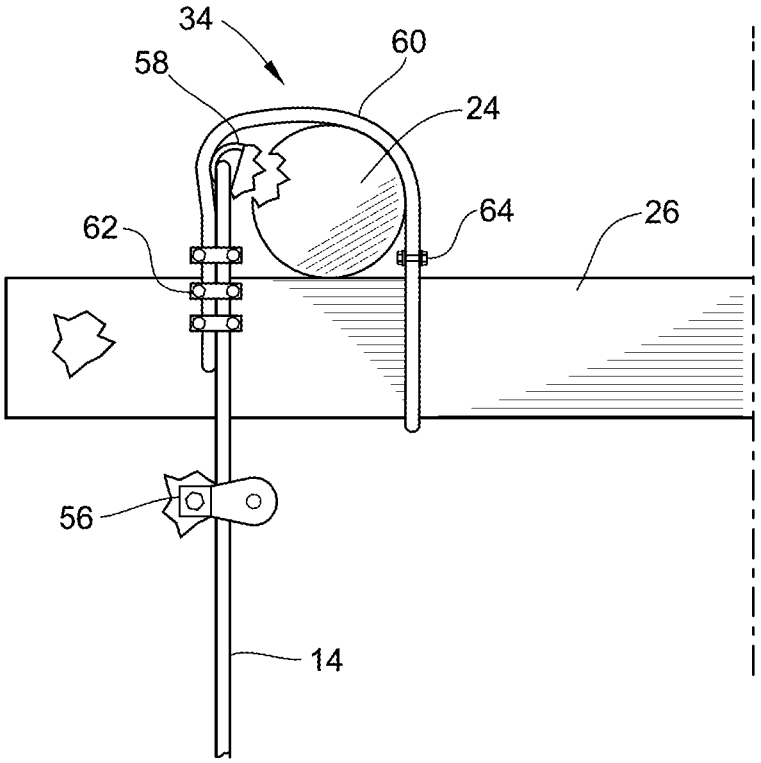
FIG. 7 is a partial top view of the cross beam and a support pole of the tower of FIG. 1 showing the safety cable in operation.

Turning now to FIG. 7, in the event that the clevis 56 and/or the mounting structure 58 break away from the cross beam 26 and/or support pole 24, the safety cable will maintain the connection of the outbound cable 14 relative to the remainder of the zip line tower 22. It will be recognized that such a configuration provides enhanced and redundant safety for the zip line tower 22. Additionally, although illustrated as incorporated with the outbound cable 14, it is recognized that the same mounting arrangement 34 incorporating a safety cable 60 can be utilized with the outbound cables 14 and/or inbound cables 16.

Figure 8:
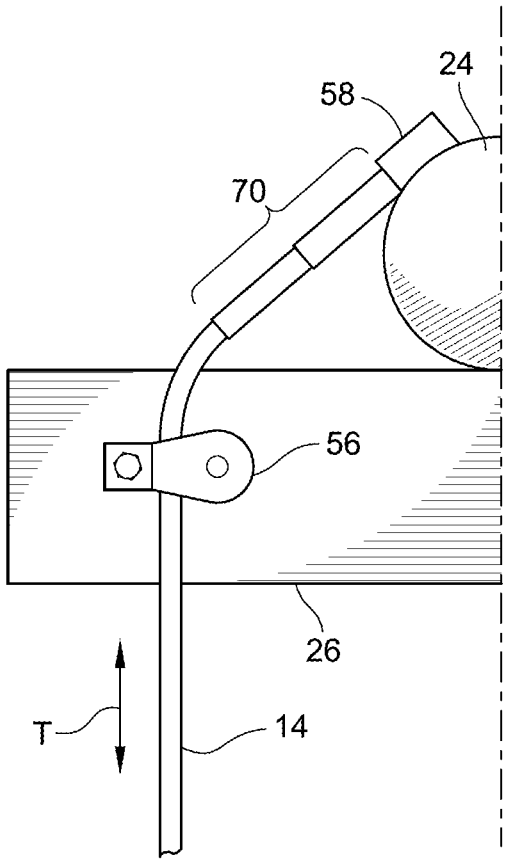
FIG. 8 is a partial top view of the cross beam and a support pole of the tower of FIG. 1 employing an adjustment mechanism.

With reference now to FIG. 8, the mounting arrangement 34 can also incorporate a tensioner 70. Similar to the termination of the outbound cable 14 discussed relative to FIGS. 6 and 7, the outbound cable 14 is illustrated as passing through a clevis 56 and terminating at a tensioner 70 connected to the mounting structure 58 mounted to the support pole 24. The tensioner 70 can be used to increase or decrease a tension T in the outbound cable 16 to compensate for thermal expansion or contraction of the outbound cable 14, or general sag in the outbound cable 14 as a result of prolonged usage thereof. Although illustrated as incorporated with one of the outbound cables 14, it is recognized that the inbound cables 16 (see FIG. 1) can also incorporate the same tensioner 70. Further, the incorporation of the tensioner 70 does not preclude or inhibit the use of the safety cable 60 (see FIGS. 6 and 7) as discussed above.

Figure 9:
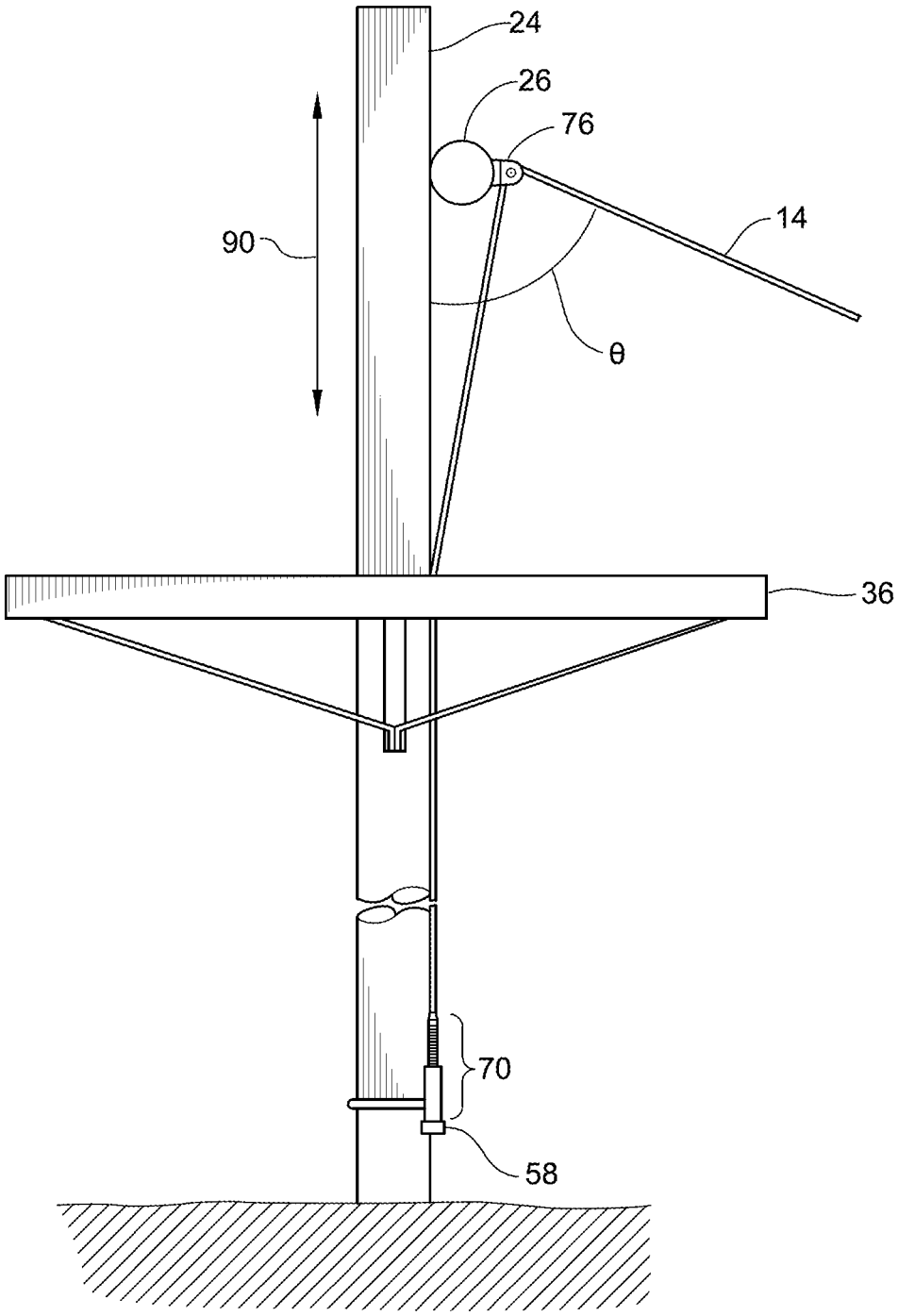
FIG. 9 is a partial side view of an alternative mounting configuration adjustment mechanism of FIG. 8.

Turning now to FIG. 9, the outbound cables 14 are illustrated in an alternative mounting configuration. In this configuration, the cables 14 pass through routing structures 76 and terminate against the support poles 24. The cables 14 can also include tensioners 70 as discussed above in this configuration. Further, additional pulleys and other routing structures (not shown) can also be included to route the cables 14 towards tensioners 70. The tensioners 70 mount to the support poles 24 such that they are accessible from the ground. In this configuration, the tension in the cables can be increased or decreased from the ground without the need to climb up to the platform 36. Further, it is recognized that this same configuration can be utilized with respect to the inbound cables 16 (see FIG. 1).

Still further, as shown in FIG. 9, the mounted location of the cross beam 26 relative to the support poles 24 is adjustable along axis 90, and on either side of the support poles 24. It will be recognized that an angle θ between the cable 14 and the support pole 24 can be manipulated by changing the mounted location at the cross beam 26. Changing the angle θ can effect the speed at which a user travels along the cable 14, as well as other ride dynamics.

Figure 10:
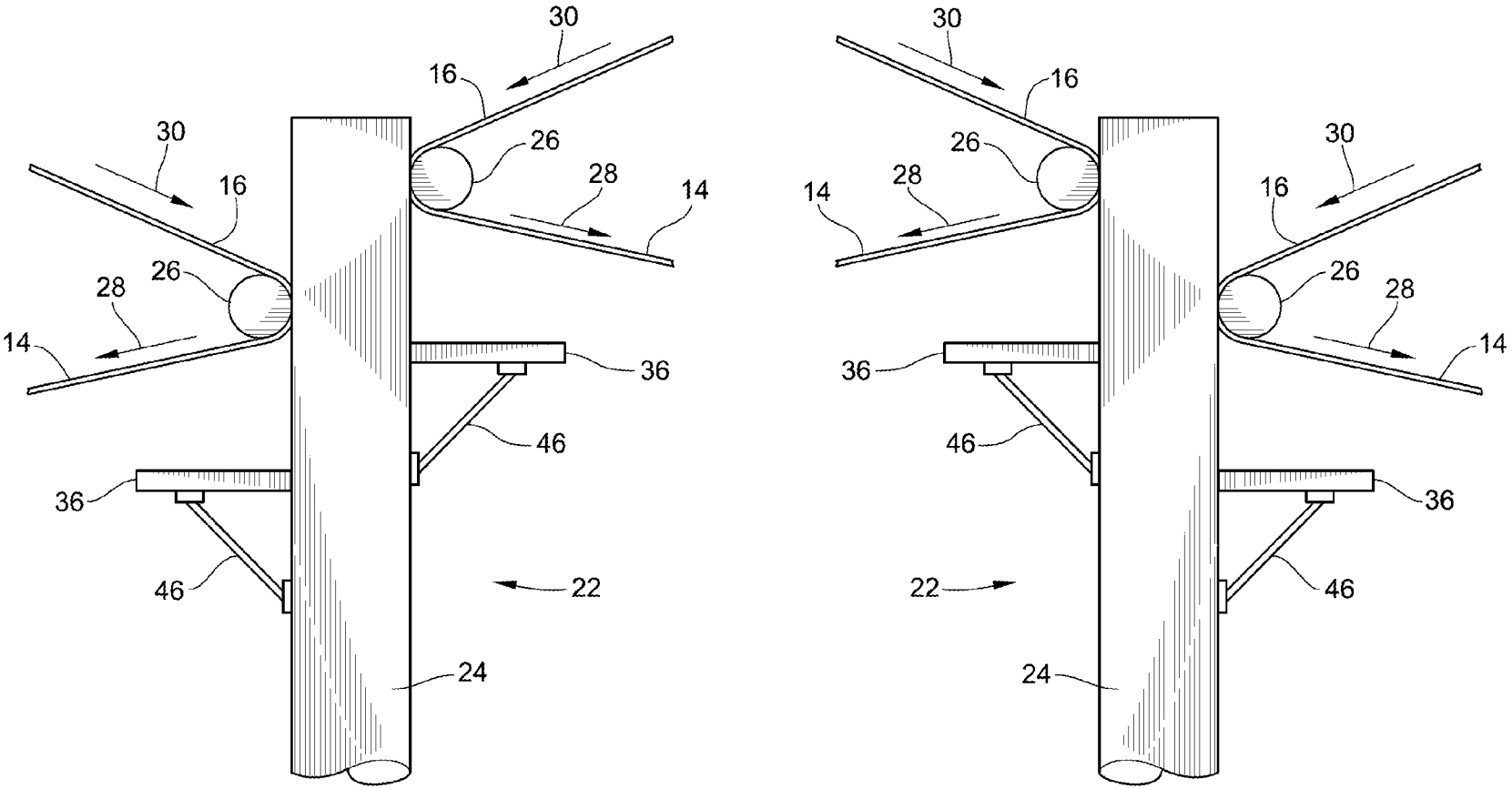
FIG. 10 is a side view of the tower of FIG. 1 employing multiple cross beams.

Turning now to FIG. 10, a portion of a zip line system or tour is illustrated incorporating multiple zip line towers 22 is illustrated. The various towers 22 of the system each incorporate multiple platforms 36 and multiple cross beams 26. Upon examination of FIG. 10, it will be recognized that in this configuration each zip line tower 22 provides for multiple inbound cables 16 and multiple outbound cables 14 at different elevations. Such a configuration allows a single zip line tower 22 to accommodate many users in a given period of time given the multiple platforms 36 that users can arrive at and depart from. Further, these towers 22 can be interconnected with one another so as to provide a tour with multiple nodes presented by each tower 22. A user can pass from tower 22 to tower 22, and more stop at each platform 36 thereof. As a result, this configuration presents the advantage over prior designs of providing a zip line tower 22 that can accommodate a relatively high amount of user traffic.

Figure 11:
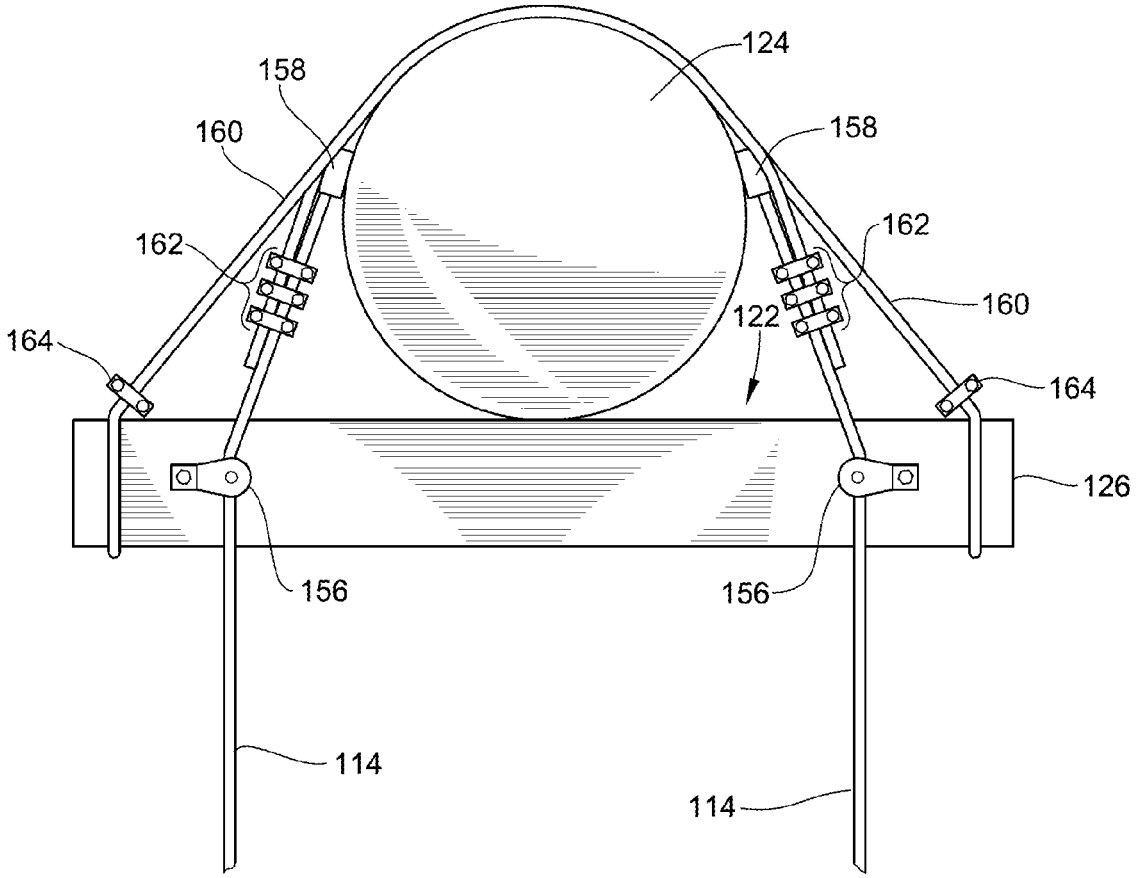
FIG. 11 is an alternative embodiment of the tower of FIG. 1 using a single cross beam and single support pole.

Turning now to FIG. 11 an alternative embodiment of a zip line tower 122 is illustrated. In this embodiment, multiple cables 114 extend away from the zip line tower 122. Each of the cables 114 passes through a clevis 156 and mounts against a single support pole 124 via a mounting structure 158. Similar to the embodiments discussed above, each of the cables 114 is also secured to a cross beam 126 carried by the support pole. The safety cables 160 mount to the outbound cables 114 at first termination points 162. The safety cables 160 also wrap around the cross beam 126 and tie off to themselves at second termination points 164. It will be recognized that the safety cables 160 present the same or similar safety features and functionality as that discussed above relative to FIGS. 6 and 7.

Figure 12:
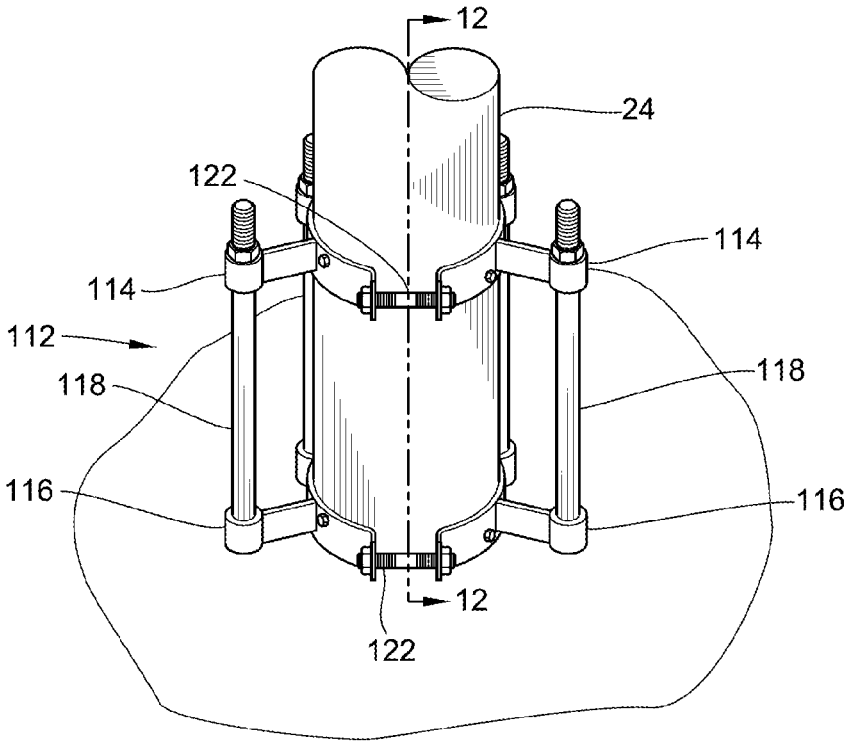
FIG. 12 is a perspective view of an anchoring device for anchoring the support poles of the tower of FIG. 1.

Turning now to FIG. 12, an anchoring system 112 for the support poles 24 can also be provided. The anchoring system 112 allows for installation of the support poles 24 in material that permits only shallow post holes, such as rock. The anchoring system 112 provides additional structural support to the support pole 24, that would otherwise be achieved by a deeper post hole for receipt of the support pole 24.

Figure 13:
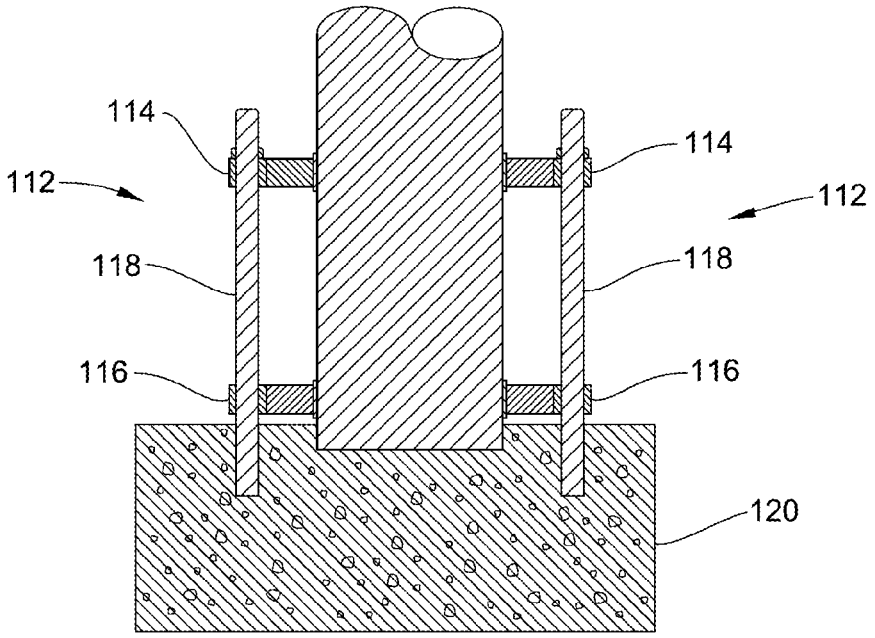
FIG. 13 is a side cross section of the anchoring device of FIG. 12.

With reference to FIG. 13, an anchoring system 112 can be associated with each support pole 24 in embodiments incorporating the same. Each anchoring system 112 includes a plurality of interconnected upper support members 114, and a plurality of interconnected lower support members 116. An adjustment spike 118 extends between each of the upper and lower support members 114, 116. A portion of the adjustment spike 118 extends into a rock bed 120 or other material to provide additional structural support for the mounting of the support pole 24.

Having described the structural attributes of several embodiments of the invention, the following provides a detailed description of the operation of the same.

Referring back to FIG. 1, to operate the zip line ride as described herein, users are first connected to the outbound cables 14. As described above, the outbound cables 14 are generally lower than the inbound cables 16 relative to the platform 36, such that a user can stand on the platform 36 while being connected. Further, multiple users can be connected to multiple outbound cables 14, depending on the particular design of the tower 12.

Once connected, users are transported between a first and a second tower 12 (second tower not shown). This transportation can include sending multiple users from the first tower to the second tower simultaneously. Upon arriving at the second tower, the users are disconnected from outbound cable 14. As discussed above, the terms "inbound" and "outbound" are relative to a particular tower such that the same cable is an outbound cable relative to the tower the user departs from, and an inbound cable relative to the tower the user arrives at.

Further, where multiple towers are used in a network configuration, users can simultaneously ride from tower to tower. The steps of connection and disconnection are described above are generally the same, except that upon disconnection at an intermediate tower, the users are thereafter reconnected to the next outbound cable in their specific tour. Still further, as described above relative to FIG. 10, a pair of towers can have multiple cross beams and platforms such that users can ride back and forth between the towers.

Users connect to the above described cables 14, 16 via a harness and mounting arrangement. The harness and mounting arrangement includes a structure for sliding along the cable that the user's harness connects to. This structure can be a wheeled assembly, or a clip (e.g. a carabiner). Additionally, a tether can be employed which extends between the cables 14, 16 and the harness that allows users to stand on a platform of the tower while remaining connected to a cable above the user that is too high to otherwise connect to without the use of the tether. When the user is ready to ride, they disconnect from the tether, and connect to the structure to ride on the cable.

As described herein, the embodiments of the invention provide a zip line tower that utilizes multiple inbound and outbound cables. By utilizing multiple inbound and outbound cables, the zip line tower can accommodate an increased amount of traffic. As a result, the wait time users would ordinarily experience for a zip line tower incorporating only a single outbound and/or inbound cable is significantly reduced.

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A zip line tower, comprising:

a support structure including at least one generally vertical support pole;

a cross beam mounted transversely to the at least one generally vertical support pole;

a platform mounted to the at least one generally vertical support pole below the cross beam; and a plurality of cables mounted to the cross beam and extending away from the cross beam over the platform and to a termination point, the plurality of cables spaced apart along the cross beam to permit simultaneous connection and use of the plurality of cables by users to travel between the platform and the termination point.

2. The zip line tower of claim 1, wherein the plurality of cables includes at least two outbound cables extending away from the cross beam at a first angle, the two outbound cables spaced apart and extending from the cross beam to allow for simultaneous departure of users to the platform.

3. The zip line tower of claim 2, wherein the plurality of cables includes at least two inbound cables extending away from the cross beam at a second angle, the two inbound cables spaced apart and extending from the cross beam to allow for simultaneous arrival of users to the platform.

4. The zip line tower of claim 3, wherein the two outbound cables that extend away from the cross beam at the first angle extend away from the cross beam in a first direction.

5. The zip line tower of claim 4, wherein the two inbound cables that extend away from the cross beam at the second angle extend away from the cross beam in a second direction, generally opposite the first direction.

6. The zip line tower of claim 1, wherein the support structure includes a pair of support poles, the cross beam mounted to the pair of support poles, and wherein at least one of the plurality of cables are positioned along the cross beam between the pair of support poles.

7. The zip line tower of claim 6, wherein at least one cable of the plurality of cables is routed through a routing structure mounted to the cross beam, the at least one cable fixedly attached to one of the pair of support poles by a mounting structure.

8. The zip line tower of claim 7, further comprising at least one safety cable having a first end and a second end, the at least one safety cable fixedly mounted to the cross beam at the first end and fixedly mounted to the at least one cable between the routing structure and the mounting structure at the second end.

9. The zip line tower of claim 8, further comprising a cable tensioning device connected between an end of the at least one cable and the mounting structure and operable to increase and decrease a tension in the at least one cable.

10. The zip line tower of claim 6, wherein at least one of the plurality of cables is mounted to the cross beam between the pair of support poles.

11. The zip line tower of claim 1, wherein a first cable of the plurality of cables is tangent to the cross beam at a first point of tangency, and a second cable of the plurality of cables is tangent to the cross beam at a second point of tangency, the first point of tangency being higher than the second point of tangency relative to the platform.

12. A zip line system, comprising:

at least two towers;

at least two cables extending between a first and a second tower of the at least two towers in a same direction; and wherein the at least two cables are operable to transport two users of the zip line system simultaneously in the same direction between the first tower and the second tower.

13. The zip line system of claim 12, wherein each of the at least two towers includes a support structure and at least one cross beam transversely mounted to the support structure.

14. The zip line system of claim 13, wherein the at least two cables are fixedly attached to the cross beam.

15. The zip line system of claim 13, wherein the at least two cables are routed through a routing structure mounted to the at least one cross beam and mount to the support structure.

16. The zip line system of claim 13, wherein the support structure is a single pole, and the at least one cross beam includes a first cross beam mounted above a second cross beam to the single pole, wherein the at least two cables includes a first pair of cables connected to the first cross beam and a second pair of cables connected to the second cross beam.

17. The zip line system of claim 13, wherein the support structure is a pair of poles, and the at least one cross beam includes a first cross beam mounted above a second cross beam to the pair of poles, wherein the at least two cables includes a first pair of cables connected to the first cross beam and a second pair of cables connected to the second cross beam.

18. A method for operating a zip line system, comprising the steps of:

connecting a first user to a first cable;

connecting a second user to a second cable, the first and second cables connected to a cross beam of a first tower and a cross beam of a second tower;

transporting the first and second users between the first and second towers.

19. The method of claim 18, wherein the step of transporting includes transporting the first and second users simultaneously in the same direction between the first and second towers.

20. The method of claim 18, further comprising the steps of disconnecting the first user from the first cable and disconnecting the second user from the second cable, wherein the steps of disconnecting are completed at a higher elevation than the steps of connecting relative to ground.

* * * * *